US012404083B2

(12) United States Patent
Lowe

(10) Patent No.: US 12,404,083 B2
(45) Date of Patent: Sep. 2, 2025

(54) COLLAPSIBLE TOTE CARRIAGE FOR BOTTLES

(71) Applicant: Timothy Lowe, Lincolnton, NC (US)

(72) Inventor: Timothy Lowe, Lincolnton, NC (US)

( * ) Notice: Subject to any disclaimer, the term of this patent is extended or adjusted under 35 U.S.C. 154(b) by 0 days.

(21) Appl. No.: 18/769,520

(22) Filed: Jul. 11, 2024

(65) Prior Publication Data

US 2025/0019138 A1 Jan. 16, 2025

Related U.S. Application Data

(60) Provisional application No. 63/513,239, filed on Jul. 12, 2023.

(51) Int. Cl.
*B65D 5/36* (2006.01)
*B65D 71/66* (2006.01)
*B65D 71/56* (2006.01)

(52) U.S. Cl.
CPC ..... *B65D 71/007* (2013.01); *B65D 71/0014* (2013.01); *B65D 2571/00444* (2013.01)

(58) Field of Classification Search
CPC ..... B65D 5/3621; B65D 5/48002; B65D 71/007; B65D 71/0014; B65D 2571/00444
USPC ..... 206/139, 167, 170–175, 180, 193
See application file for complete search history.

(56) References Cited

U.S. PATENT DOCUMENTS 2,606,711 A * 8/1952 Forrer ..... B65D 71/0022 229/117.14
4,047,610 A * 9/1977 Stout ..... B65D 71/0014 206/187
4,678,154 A 7/1987 McFarland
4,767,092 A 8/1988 Weatherly
5,042,770 A 8/1991 Louthan
6,024,212 A * 2/2000 Whitnell ..... B65D 71/0014 206/185
6,089,638 A * 7/2000 Whitnell ..... B65D 71/0014 206/175
6,834,762 B2 12/2004 Krisko
8,146,737 B2 4/2012 D'Agostino
2006/0091024 A1* 5/2006 Cuomo ..... B65D 71/0022 206/427
2007/0017828 A1* 1/2007 Cuomo ..... B65D 71/0014 206/170
2008/0169397 A1 7/2008 Somuah
2020/0079562 A1* 3/2020 Holley, Jr. ..... B31B 50/73
2021/0371178 A1* 12/2021 Gungner ..... B65D 71/0022

* cited by examiner

*Primary Examiner* — Luan K Bui

(74) *Attorney, Agent, or Firm* — Brennan, Manna & Diamond, LLC

(57) ABSTRACT

A foldable tote designed for safely transporting large bottles of liquid is disclosed. The tote features two individual compartments, each with a base and three walls extending vertically, designed to securely hold large bottles. A handle, which includes an ergonomic aperture, extends between the compartments and forms a common wall. The tote transitions from a folded, compact state to an unfolded, functional state through the movement of inner tabs and triangular members that lock into place to provide a solid base for each compartment. The inner tabs fold from a vertical position adhered to the compartment walls to a horizontal position covering the base. The compartments extend halfway up the bottle height, preventing tilting and ensuring safe transport.

20 Claims, 8 Drawing Sheets

COLLAPSIBLE TOTE CARRIAGE FOR BOTTLES

CROSS-REFERENCE TO RELATED APPLICATION

The present application claims priority to, and the benefit of, U.S. Provisional Application No. 63/513,239, which was filed on Jul. 12, 2023, and is incorporated herein by reference in its entirety.

FIELD OF THE INVENTION

The present invention generally relates to the field of totes. More specifically, the present invention relates to a novel foldable tote for safely transporting 2-liter bottles of liquid. The tote is made of corrugated cardboard or any durable, reusable material. The tote unfolds with inner tabs that are to be pushed down to complete the base of the tote. In the unfolded state, two individual compartments are sized to each receive a 2-liter bottle. A handle having an aperture is included for holding and transporting the tote. Accordingly, the present disclosure makes specific reference thereto. Nonetheless, it is to be appreciated that aspects of the present invention are also equally applicable to other like applications, devices, and methods of manufacture.

BACKGROUND

By way of background, 2-liter plastic bottles of beverages are commonly used by individuals. However, transporting 2-liter plastic bottles filled with soda, juice, and other beverages or liquids often is challenging. Commonly, individuals use plastic bags to carry these heavy bottles but it frequently results in torn handles and ripped seams, leading to dropped bottles and potential leakage. Dropped bottles causes inconvenience, waste, and mess. Additionally, placing bottles on a vehicle seat can cause them to roll around during transit, resulting in the contents becoming excessively shaken and possibly spilling upon opening.

Carrying multiple 2-liter beverage bottles is particularly problematic for food delivery personnel, who face difficulties in securely storing and transporting multiple 2-liter beverage bottles for their clients. Due to the lack of a reliable and durable solution for carrying these bottles safely and conveniently, individuals desire a sturdy, reusable, and foldable tote for carrying such bottles.

Therefore, there exists a long felt need in the art for a tote for securely storing and transporting up to two, 2-liter bottles full of liquid. There is also a long felt need in the art for a sturdy, reusable, and foldable tote specifically designed for the safe transportation of a plurality 2-liter bottles. Additionally, there is a long felt need in the art for a specially designed tote that can be collapsed when it is not required to carry bottles. Moreover, there is a long felt need in the art for a unique tote to provide a secure fit for at least a pair of 2-liter bottles, preventing them from rolling or tilting during transit. Further, there is a long felt need in the art for a tote that eliminates the need to store 2-liter bottles in a plastic bag. Finally, there is a long felt need in the art for a uniquely designed tote that provides a visually appealing way to transport and store bottles, enhancing the overall user experience.

The subject matter disclosed and claimed herein, in one embodiment thereof, comprises a foldable tote for safely transporting 2-liter bottles of liquid. The tote includes a first compartment and a second compartment, each having a base and three walls extending vertically upward from the base, a handle extends between the first compartment and the second compartment, forms a common wall for both compartments, the handle includes an aperture for carrying the tote, a foldable inner tab is associated with each compartment, the inner tab is configured to move from a vertical folded position adhered to one of the walls to a horizontal position covering and locking into the base, forming a support for a bottle. Foldable triangular members are positioned under the inner tabs, the triangular members being adapted to provide additional strength to the bases when the tote is in the unfolded state.

In this manner, the bottle carriage tote of the present invention accomplishes all of the forgoing objectives and provides users with a novel tote that addresses the shortcomings of traditional carrying methods by providing a sturdy, reusable, and foldable tote specifically designed for the safe transportation of 2-liter bottles. The tote is designed to withstand the weight of 2-liter bottles without tearing or breaking, ensuring long-term use. The foldable design enables the tote to be compactly stored when not in use, saving space and making it convenient to keep in vehicles, homes, or workplaces. The individual compartments provide a secure fit for 2-liter bottles, preventing them from rolling or tilting during transit. The stability reduces the risk of spills and the contents getting excessively shaken. The inner tabs and triangular members provide additional support to the base, ensuring the compartments are strong and stable.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a foldable tote for safely transporting 2-liter bottles of liquid. The tote includes a first compartment and a symmetrical second compartment, each compartment including a base and three walls extending vertically upward from the base, the compartments being sized to receive 2-liter bottles. A handle extends between the first compartment and the second compartment and forms a common wall for both compartments, the handle includes an aperture for carrying the tote. An inner tab is associated with each compartment, the inner tabs are foldable to cover and strengthen the respective bases, thereby forming a solid base for each compartment. The tote is foldable to a compact form when not in use and unfoldable to retain the tote shape for carrying bottles. The tote will aid in reducing plastic bag usage, as no double bagging will be necessary. The tote may also be compostable or reusable.

In yet another embodiment, a beverage bottles carriage tote is disclosed. The tote includes a first compartment and a second compartment, each having three walls and a base, each compartment being configured to independently carry a single 2-liter bottle. A handle is disposed between the compartments and forms a common wall for both compartments and includes an aperture for ergonomic handling. A foldable inner tab is secured to one wall of each compartment, the tabs being movable to a horizontal position to cover the base and overlap a foldable triangular member for providing additional support to the base.

In another embodiment, the tote is made of corrugated cardboard.

In another aspect, the compartments have a height between 4 inches and 6 inches and the handle extends between two times and four times the height of the compartments.

In yet another aspect, a foldable tote for safely transporting a plurality of 2-liter bottles of liquid is disclosed. The tote includes a first compartment and a second compartment, each compartment having a base and three walls extending vertically upward from the base, a handle extends between the first compartment and the second compartment, forms a common wall for both compartments, the handle includes an aperture for carrying the tote, a foldable inner tab is associated with each compartment, the inner tab is configured to move from a vertical folded position adhered to one of the walls to a horizontal position covering and locking into the base, forming a support for a bottle. Foldable triangular members are positioned under the inner tabs, the triangular members being adapted to provide additional strength to the bases when the tote is in the unfolded state.

The tote transitions from a compact, folded state to an unfolded state by unfolding the compartments to an open position, moving the inner tabs from the folded position to the horizontal position to cover the bases and lock into place, and positioning the triangular members beneath the inner tabs to provide additional support to the bases, thereby forming secure compartments for carrying the bottles.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
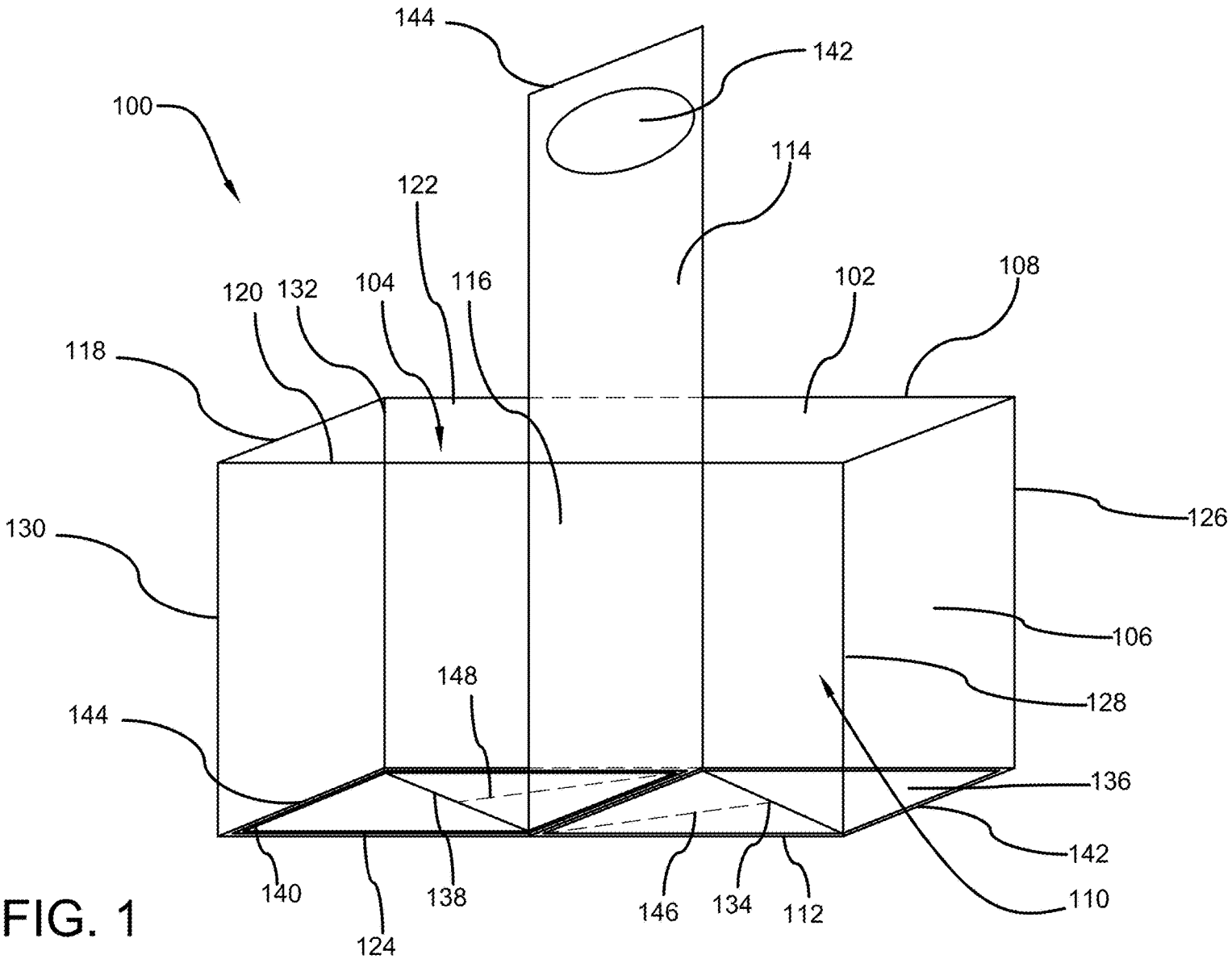
FIG. 1 illustrates a perspective view of beverage bottles carriage tote of the present invention in an unfolded position in accordance with the disclosed structure.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long felt need in the art for a tote for securely storing and transporting a plurality of 2-liter bottles full of liquid. There is also a long felt need in the art for a sturdy, reusable, and foldable tote specifically designed for the safe transportation of 2-liter bottles. Additionally, there is a long felt need in the art for a specially designed tote that can be collapsed when it is not required to carry bottles. Moreover, there is a long felt need in the art for a unique tote to provide a secure fit for 2-liter bottles, preventing them from rolling or tilting during transit. Further, there is a long felt need in the art for a tote that eliminates the need to store 2-liter bottles in a plastic bag. Finally, there is a long felt need in the art for a uniquely designed tote that provides a visually appealing way to transport and store bottles, enhancing the overall user experience.

The present invention, in one exemplary embodiment, is a beverage bottle carriage tote. The tote includes a first compartment and a second compartment, each compartment having three walls and a base, the each compartment being configured to independently carry a 2-liter bottle. A handle is disposed between the compartments and forms a common wall for both compartments and includes an aperture for ergonomic handling. A foldable inner tab is secured to one wall of each compartment, the tabs being movable to a horizontal position to cover the base and overlap a foldable triangular member for providing additional support to the base.

Reference will now be made in detail to the present preferred embodiments of the invention, examples of which are illustrated in the accompanying drawings. Wherever possible, the same reference numerals are used in the drawings and the description to refer to the same or like parts.

Referring initially to the drawings, FIG. 1 illustrates a perspective view of beverage bottles carriage tote of the present invention in an unfolded position in accordance with the disclosed structure. The beverage bottles carriage tote 100 of the present invention is designed for safely transporting bottles of liquid and preferably 2-litre bottles of liquid. The tote 100 can be made from corrugated cardboard or another durable, reusable material. More specifically, the tote 100 is foldable and can be folded to a compact form when not in use. The tote 100 can be unfolded to retain the tote shape for carrying bottles.

The tote 100 includes a first compartment 102 and a symmetrical second compartment 104 for carrying bottles. The compartments 102, 104 are individual and can be independently used for carrying bottles. The first compartment 102 includes three walls 106, 108, 110 extending vertically upward from a base 112. A handle 114 used for carrying the tote 100 in the unfolded position extends between the individual compartments 102, 104 and forms the common wall 116 for the compartments 102, 104. The second compartment 104 also includes three walls 118, 120, 122 that extend vertically upward from the base 124 thereof.

The wall 106 of the first compartment 102 and the wall 118 of the second compartment 104 are substantially parallel to the handle 114. The walls 108, 110 of the first compartment 102 extend from the opposite side edges 126, 128 of the wall 106 to the common wall 116. Similarly, the walls 120, 122 of the second compartment 104 extend from the opposite side edges 130, 132 of the wall 118 to the common wall 116.

The base 112 includes a first foldable triangular member 134 that is adapted to cover a portion of the base 112. An inner tab 136 is adhered to the wall 106 and is configured to be pulled towards the base 112 to overlap the triangular member 134 to cover the base 112. The tab 136 is locked in the horizontal position at the base 112 and is configured to create a solid base for the compartment 102.

The base 124 includes a corresponding foldable triangular member 138 adapted to form a portion of the base 124. A corresponding inner tab 140 of the second compartment 104 is pulled to strengthen the base 124 to support a bottle stored in the second compartment 104. The inner tabs 136, 140 are pivotally movable along the sewn edges 142, 144 (which are bottom edges of the walls 106, 118) thereof for enabling the tabs 136, 140 to move from the installed position as illustrated in FIG. 1 to a folded position as described later in the disclosure. The handle 114 also includes an aperture 142 disposed near the top end 144 of the handle 114. The aperture 142 is preferably oval but can be of any geometric shape and is adapted to be easily held by a user using fingers for carrying the tote 100.

Figure 2:
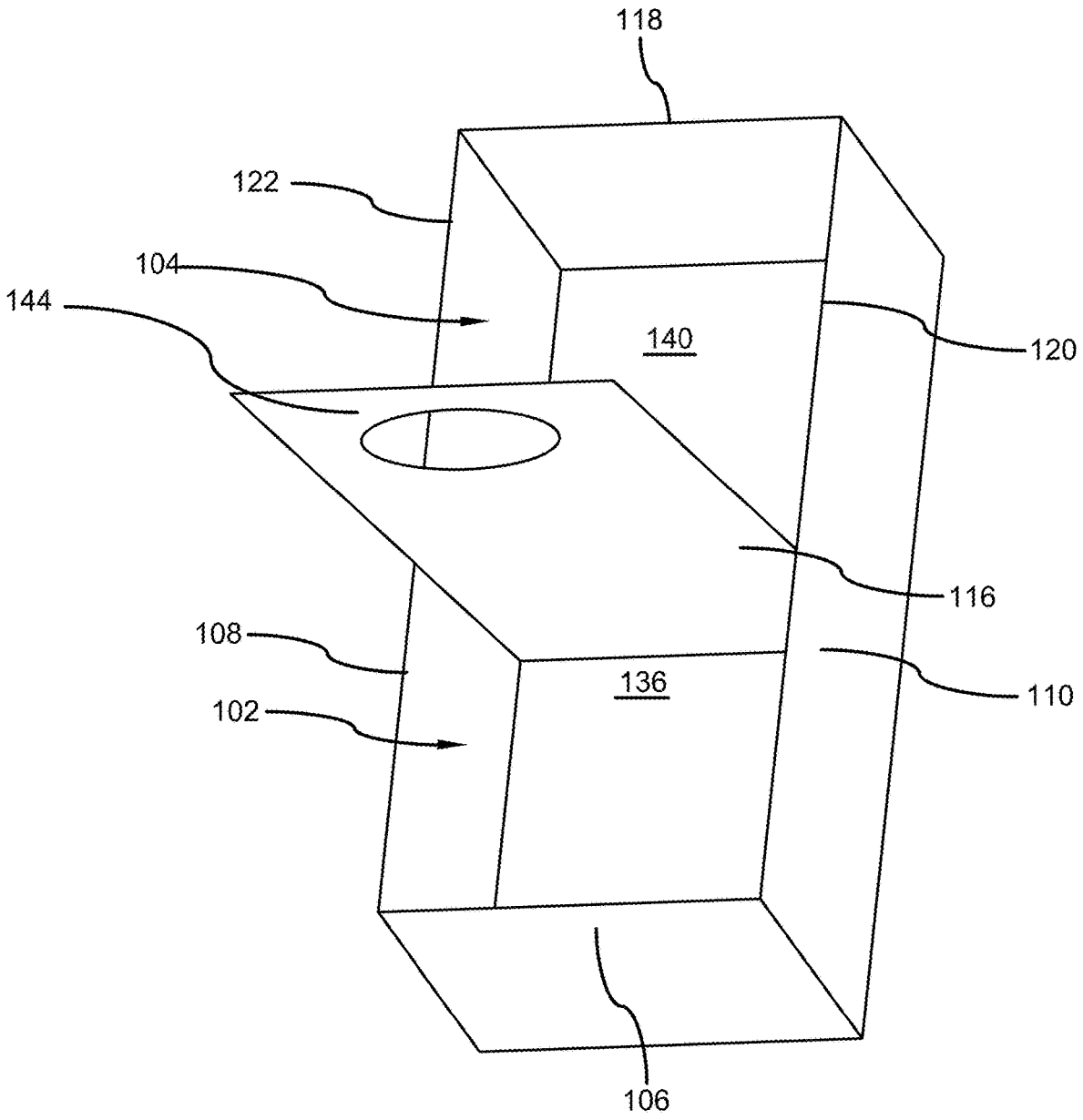
FIG. 2 illustrates a top perspective view of the bottle carriage tote of the present invention in the unfolded position in accordance with the disclosed structure.

FIG. 2 illustrates a top perspective view of the bottle carriage tote of the present invention in the unfolded position in accordance with the disclosed structure. The handle 114 extends above the compartments 102, 104 such that the tote 100 can be easily handled and carried by a user. As illustrated, in the unfolded state, the inner tabs 136, 140 are in a pulled position to substantially cover the base 112, 124 for supporting the accommodated bottles. The triangular members 134, 138 are positioned underneath the inner tabs 136, 140 to provide additional strength to the base 112, 124. In the preferred embodiment, the compartments 102, 104 have a height from about 4" to about 6" to prevent the accommodated bottles from tilting or falling off. The handle 116 can have a height from about two times to about four times of the height of the compartments 102, 104.

Figure 3:
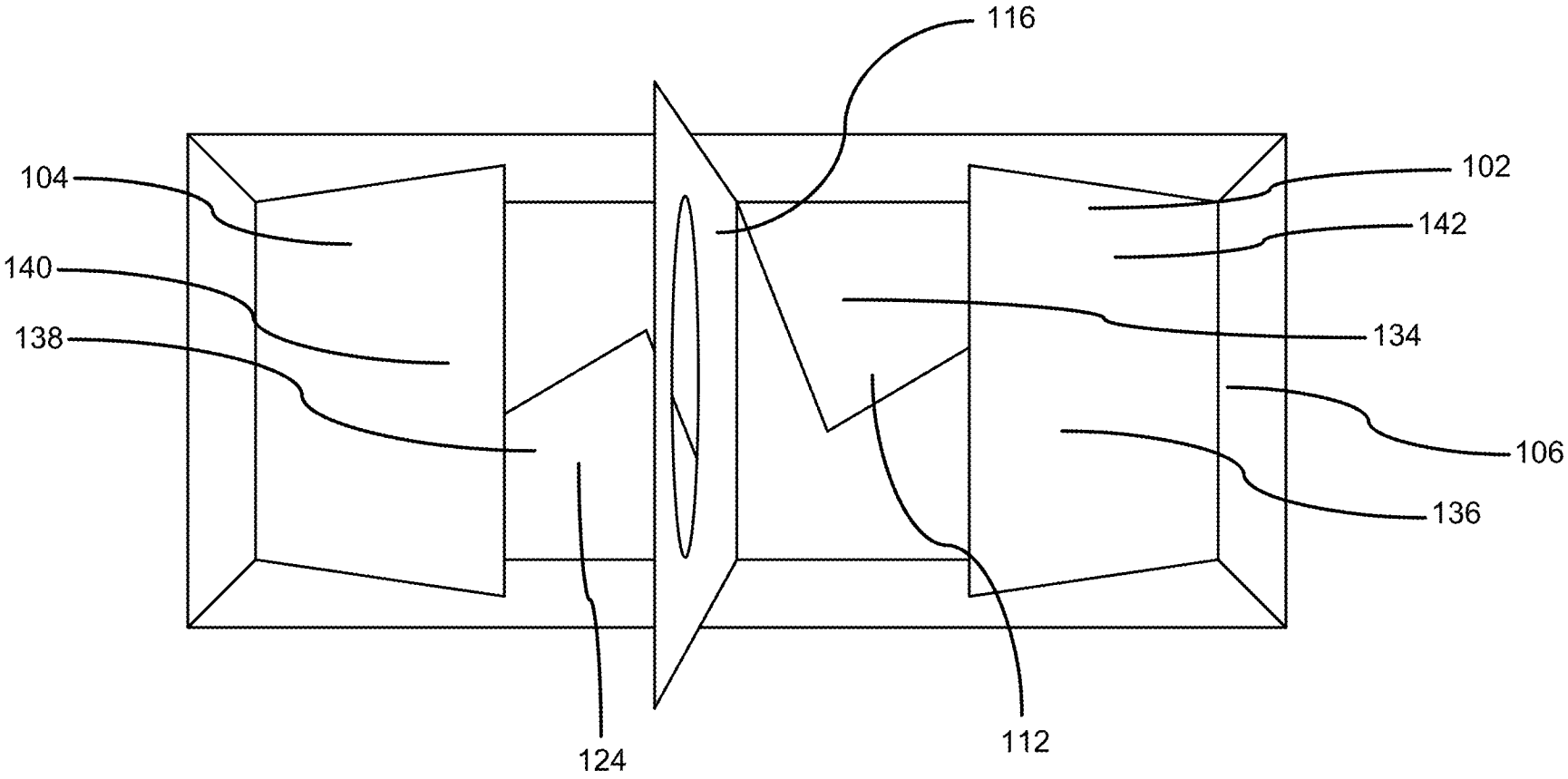
FIG. 3 illustrates a top perspective view of the bottle carriage tote of the present invention showing the pulling of inner tabs to cover the base to fully transition the tote in the unfolded state in accordance with the disclosed structure.

FIG. 3 illustrates a top perspective view of the bottle carriage tote of the present invention showing the pulling of inner tabs to cover the base to fully transition the tote in the unfolded state in accordance with the disclosed structure. As illustrated, the tab 136 is pulled down to cover the base 112 and overlap the triangular member 134 to unfold the bottles carriage tote 100 and strengthen the base 112. The tab 136 is sturdy and is adapted to move along the edge 142. When the tote 100 is not required, the tab 136 can be pulled back to adhere to the wall 106.

The tab 140 is similarly transitioned to cover the base 124 to overlap the triangular member 138. The tabs 136, 140 provide a strong and stable base for the bottles accommodated in the compartments 102, 104. It will be apparent to a person skilled in the art that the inner tabs 136, 140 can adhere to any wall of the compartments 102, 104 and further, are dimensioned to cover the base of the compartments.

Figure 4:
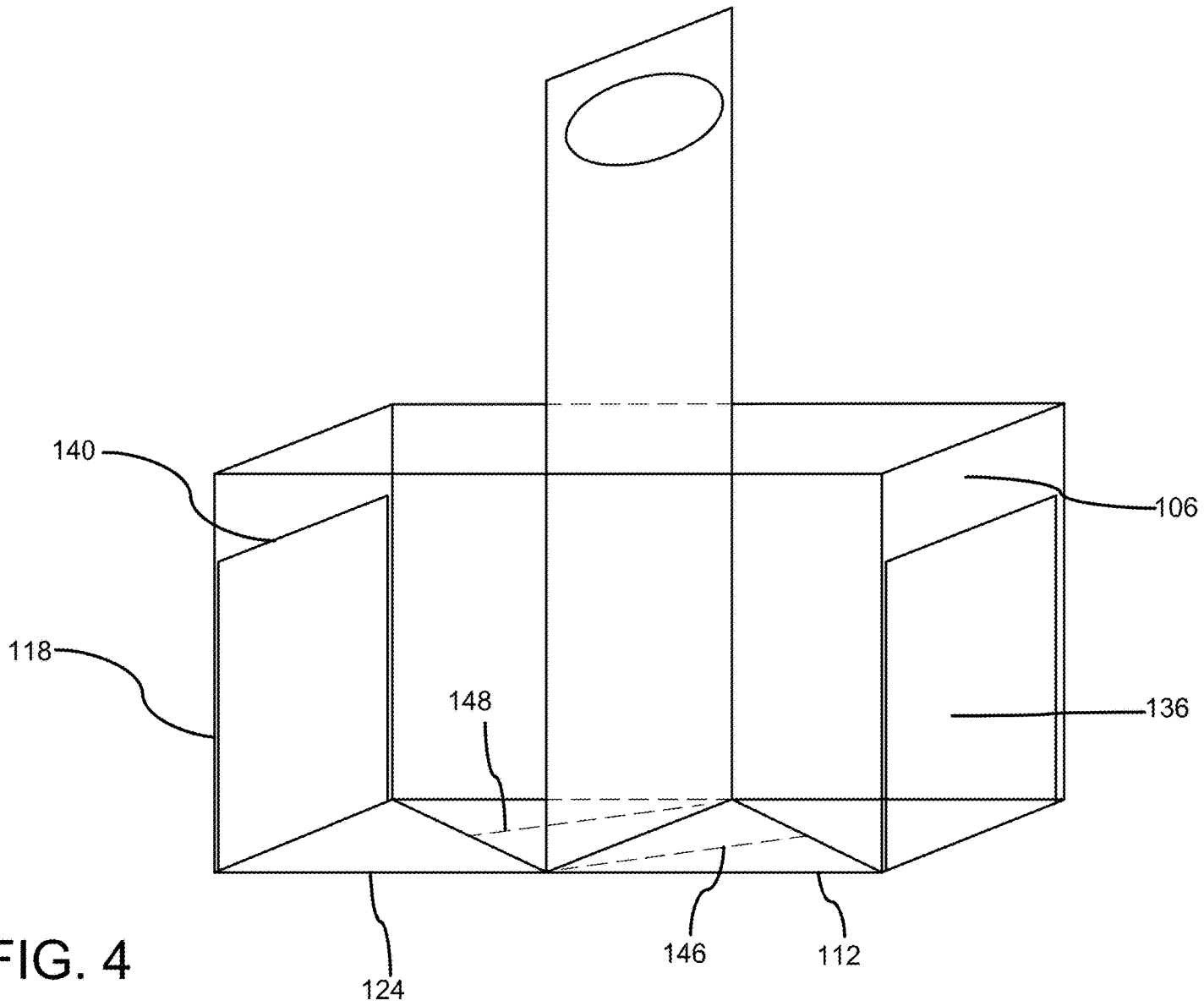
FIG. 4 illustrates a perspective view showing the tote with the inner tabs in the folded position and adhered to the sidewalls of the compartments in accordance with the disclosed structure.

FIG. 4 illustrates a perspective view showing the tote with the inner tabs in the folded position and adhered to the sidewalls of the compartments in accordance with the disclosed structure. When the tote 100 is required to be folded, the inner tabs 136, 140 are folded from the substantial horizontal position as illustrated in FIGS. 1-2 to adhere to one of the walls such as 106 of the compartment 102 and the wall 118 of the second compartment 104. In the folded state, the inner tabs 136, 140 remain adhered to the walls of the compartments 102, 104. The inner tabs 136, 140 are of substantially the same size as of the bases 112, 124, respectively.

Figure 5:
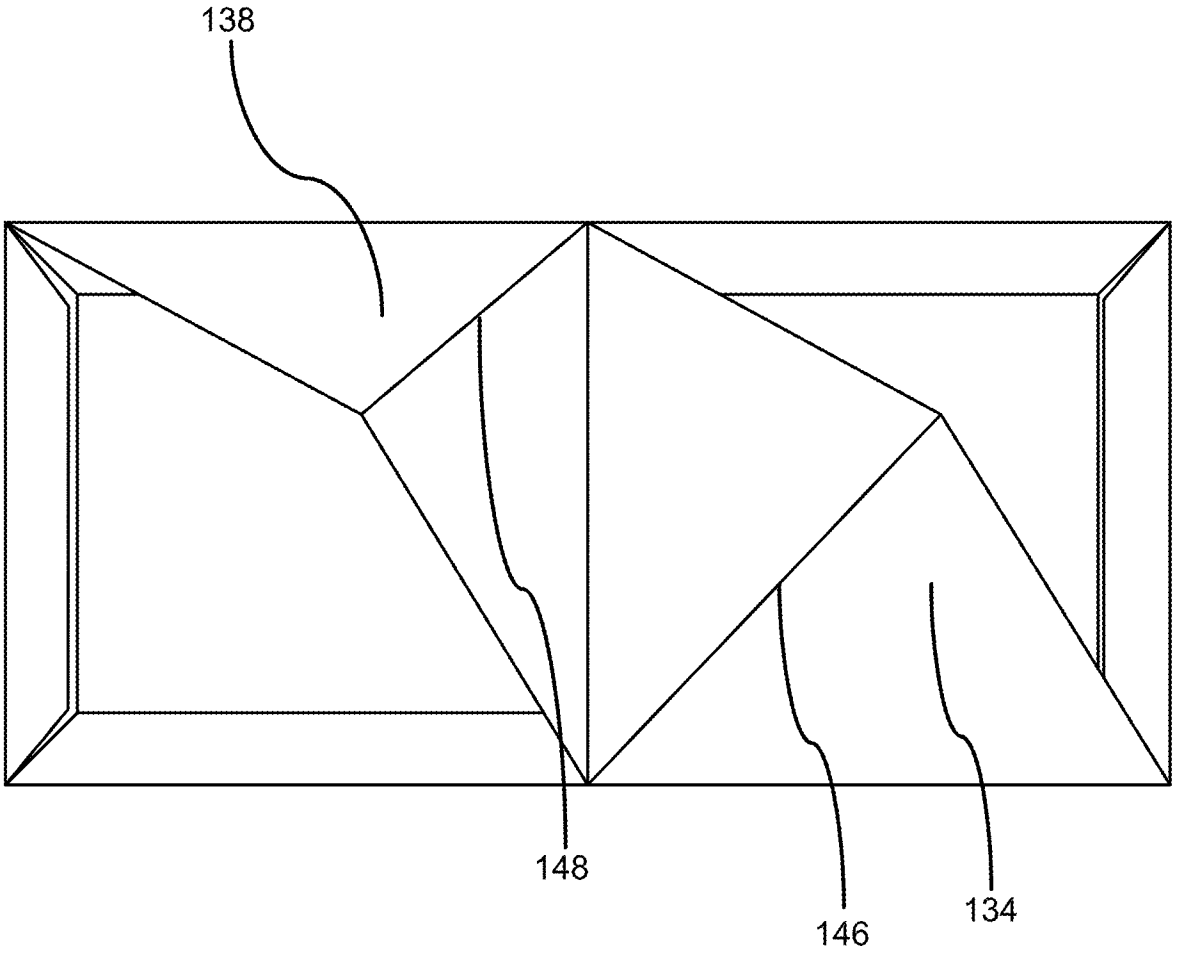
FIG. 5 illustrates a bottom perspective view of the tote with the inner tabs in the folded state in accordance with the disclosed structure.

FIG. 5 illustrates a bottom perspective view of the tote with the inner tabs in the folded state in accordance with the disclosed structure. The triangular member 134 is adapted to cover a portion of the base 112 and is configured to be folded along the folding edge or bisecting line 146 (FIGS. 1 and 5) when the tote 100 is folded. The triangular member 134 in the folded state enables the compartment 102 to be folded to the folded state as illustrated in FIG. 6B. Similarly, the triangular member 138 is adapted to be foldable along the folding edge or bisecting line 148.

Figure 6A:
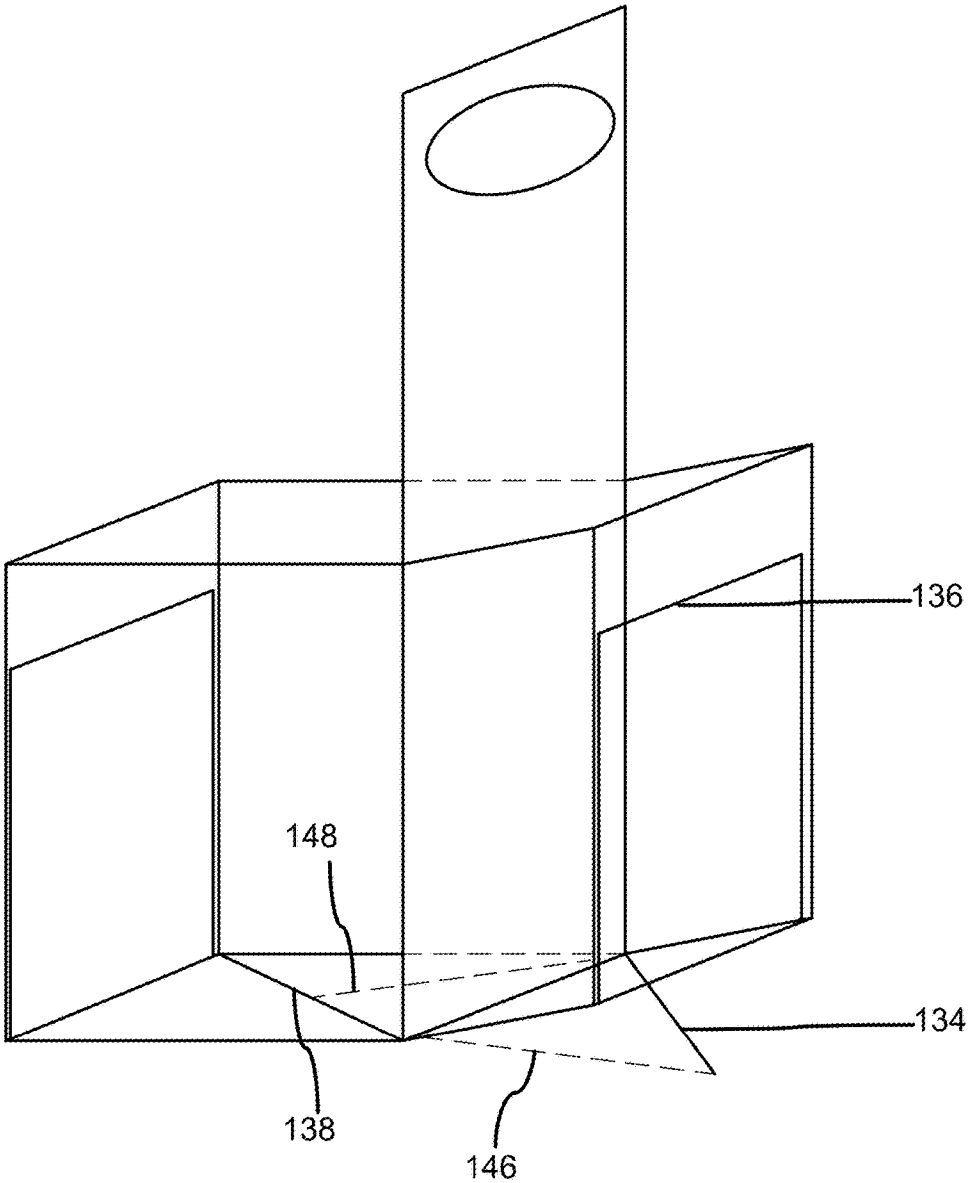
FIG. 6A illustrates a perspective view showing folding of a triangular member for folding the compartment to collapse the tote in accordance with the disclosed structure.
Figure 6B:
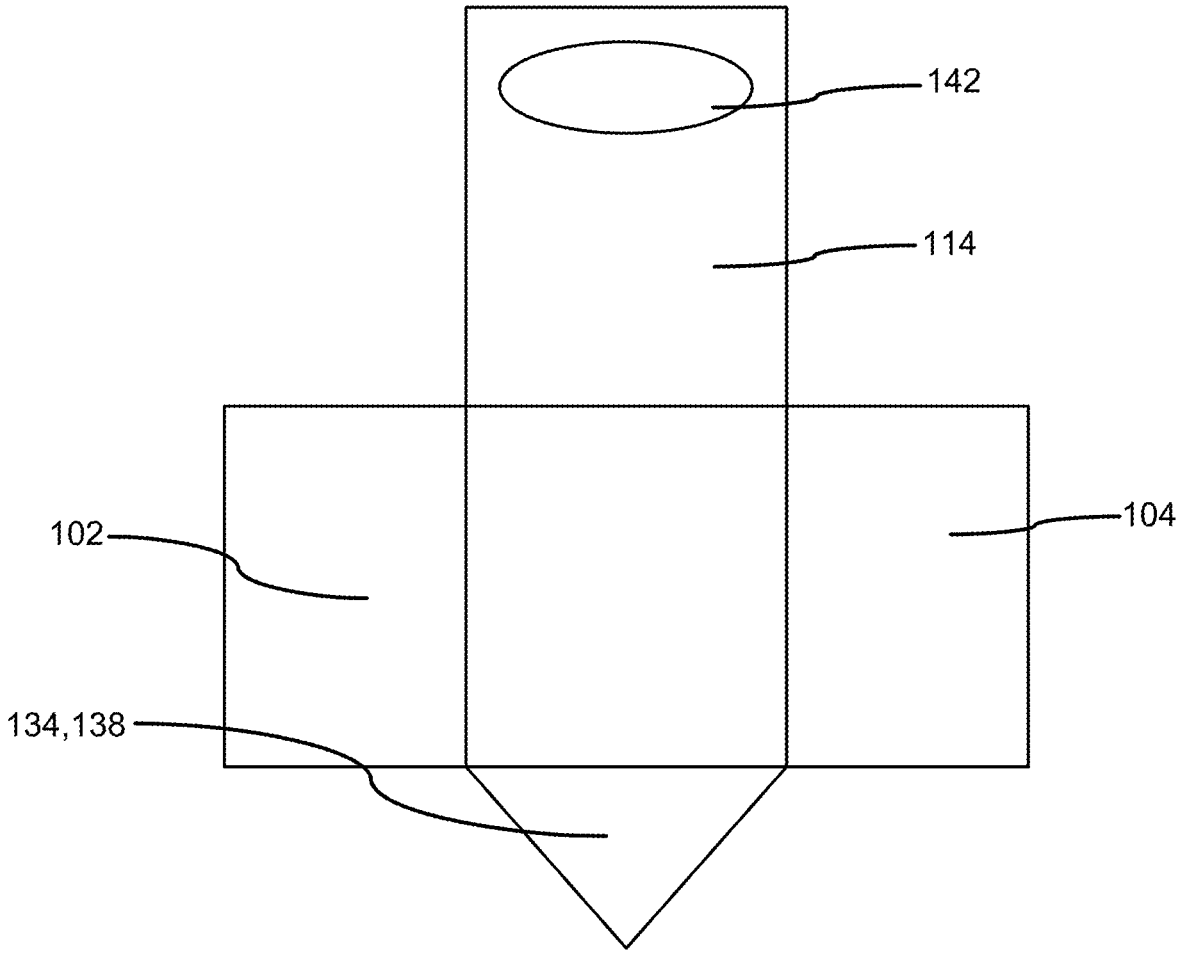
FIG. 6B illustrates the bottles carriage tote of the present invention in a collapsed or folded state in accordance with the disclosed structure.

Referring now to FIGS. 5, 6A, and 6B, when the triangular members 134, 138 are folded, the triangular members 134, 138 extend down from the bases 112, 124 enabling the walls of the compartments 102, 104 to collapse and positioned on opposite sides of the handle 116.

FIG. 6A illustrates a perspective view showing folding of a triangular member for folding the compartment 102 to collapse the tote in accordance with the disclosed structure. The triangular member 134 is folded along the folding edge 146 to extend below the compartment 102. The triangular member 134 is folded after folding the inner tab 136. Similarly, the second triangular member 138 is also folded, thereby facilitating folding of the durable and reusable beverage bottle carriage tote 100 when is not required for carrying bottles.

FIG. 6B illustrates the bottles carriage tote of the present invention in a collapsed or folded state in accordance with the disclosed structure. In the folded state, the compartments 102, 104 are collapsed to become flat and the triangular members 134, 138 are folded to extend below the handle 116 and the compartments 102, 104. The handle 116 is elongated and the aperture 142 can be used for carrying the tote 100 in the collapsed state.

Figure 7:
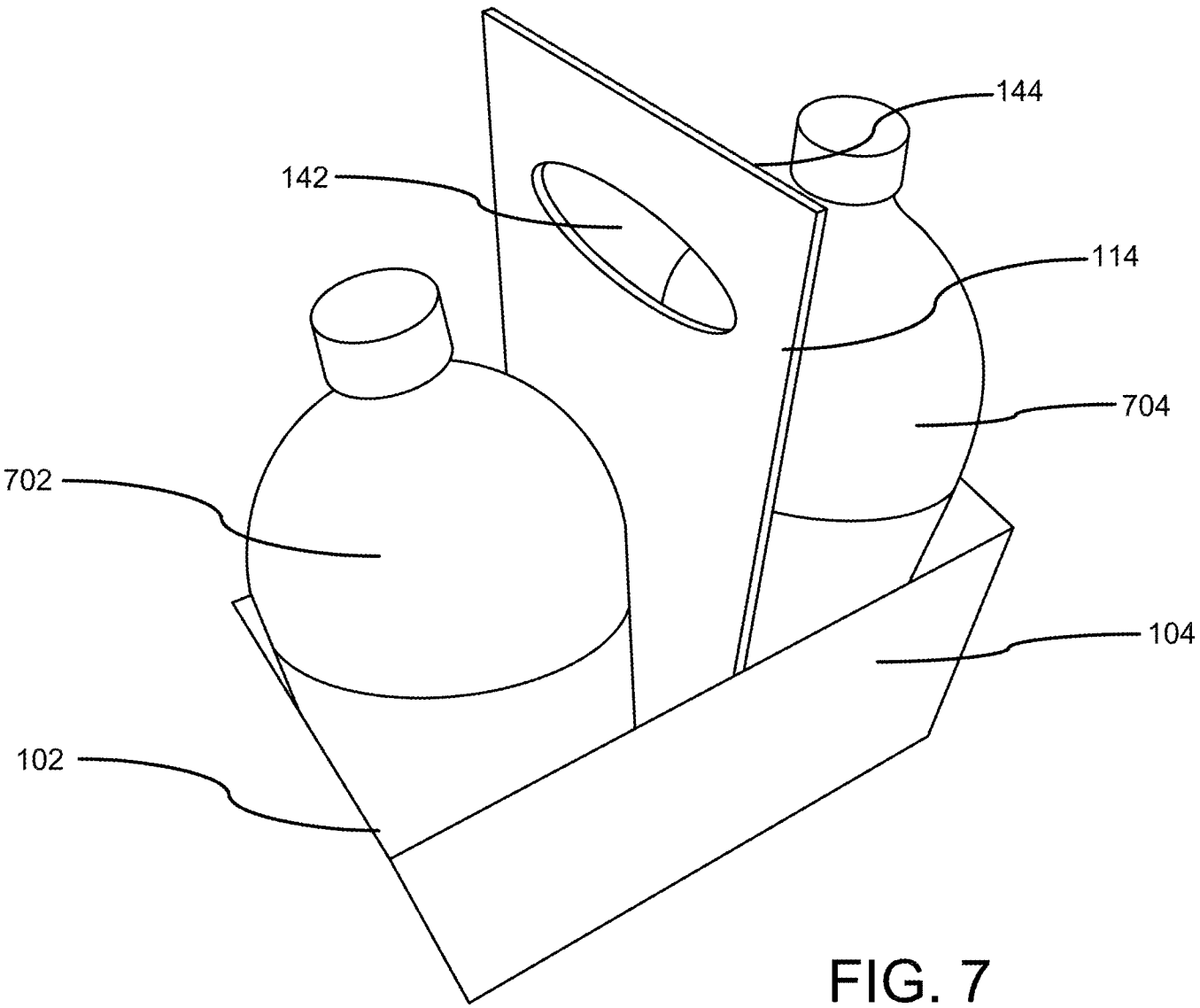
FIG. 7 illustrates a perspective view showing the two bottles accommodated in the tote for transportation in accordance with the disclosed structure.

FIG. 7 illustrates a perspective view showing the two bottles accommodated in the durable and reusable beverage bottle carriage tote for transportation in accordance with the disclosed structure. A first bottle 702 is accommodated in the first compartment 102 and a second bottle 704 is accommodated in the second compartment 104. The bottles 702, 704 are stored in the upright position and walls 106, 108, 110 of the first compartment 102 and the walls 118, 120, 122 of the second compartment 104 prevent the bottles 702, 704 from tilting or displacing laterally. The aperture 142 is ergonomically held by a user to carry the bottles easily and conveniently.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "durable and reusable beverage bottle carriage tote", "bottles carriage tote", "beverage bottles carriage tote", and "tote" are interchangeable and refer to the bottle carriage foldable tote 100 of the present invention.

Notwithstanding the forgoing, the bottle carriage foldable tote 100 of the present invention can be of any suitable size and configuration as is known in the art without affecting the overall concept of the invention, provided that it accomplishes the above stated objectives. One of ordinary skill in the art will appreciate that the bottle carriage foldable tote 100 as shown in the FIGS. are for illustrative purposes only, and that many other sizes and shapes of the bottle carriage foldable tote 100 are well within the scope of the present disclosure. Although the dimensions of the bottle carriage foldable tote 100 are important design parameters for user convenience, the bottle carriage foldable tote 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A tote for carrying 2-liter bottles comprising:

a bottle carrying tote convertible from a folded position to an unfolded position;

a first compartment having a first plurality of walls;

a second compartment having a second plurality of walls;

a handle; and a common wall;

wherein said first plurality of walls extending vertically upward from a first base;

wherein said second plurality of walls extending vertically upward from a second base;

wherein said handle having an aperture for enabling a plurality of fingers to extend therethrough;

wherein said handle extending between said first compartment and said second compartment when said bottle carrying tote is in said unfolded position;

wherein said common wall extending between said first compartment and said second compartment;

wherein said first plurality of walls having a first outer wall;

wherein said second plurality of walls having a second outer wall;

wherein said first outer wall and said second outer wall parallel to said handle;

wherein said first base having a first foldable triangular member adapted to cover a portion of said first base;

wherein said second base having a second foldable triangular member adapted to cover a portion of said second base;

wherein said first outer wall having a first inner tab hingedly adhered to said first outer wall and movable towards said first base for overlapping said first foldable triangular member and covering said first base; and further wherein said second outer wall having a second inner tab hingedly adhered to said second outer wall and movable towards said second base for overlapping said second foldable triangular member and covering said second base.

2. The tote for carrying 2-liter bottles of claim 1, wherein said aperture having an oval geometric shape.

3. The tote for carrying 2-liter bottles of claim 1, wherein said first inner tab hingedly adhered to a bottom edge of said first outer wall.

4. The tote for carrying 2-liter bottles of claim 3, wherein said second inner tab hingedly adhered to a bottom edge of said second outer wall.

5. The tote for carrying 2-liter bottles of claim 4, wherein said first inner tab is horizontal when said bottle carrying tote is in said unfolded position.

6. The tote for carrying 2-liter bottles of claim 5, wherein said second inner tab is horizontal when said bottle carrying tote is in said unfolded position.

7. The tote for carrying 2-liter bottles of claim 6, wherein said first inner tab is vertical when said bottle carrying tote is in said folded position.

8. The tote for carrying 2-liter bottles of claim 7, wherein said second inner tab is vertical when said bottle carrying tote is in said folded position.

9. The tote for carrying 2-liter bottles of claim 8, wherein said first foldable triangular member folded along a first bisecting line when said bottle carrying tote is in said folded position.

10. The tote for carrying 2-liter bottles of claim 9, wherein said second foldable triangular member folded along a second bisecting line when said bottle carrying tote is in said folded position.

11. The tote for carrying 2-liter bottles of claim 10, wherein said first foldable triangular member horizontal when said bottle carrying tote is in said unfolded position.

12. The tote for carrying 2-liter bottles of claim 11, wherein said second foldable triangular member horizontal when said bottle carrying tote is in said unfolded position.

13. The tote for carrying 2-liter bottles of claim 12, wherein said first plurality of walls having a first pair of parallel walls extending orthogonally between said first outer wall and said common wall.

14. The tote for carrying 2-liter bottles of claim 13, wherein said second plurality of walls having a second pair of parallel walls extending orthogonally between said second outer wall and said common wall.

15. The tote for carrying 2-liter bottles of claim 14, wherein said first compartment and said second compartment having a height from 4 inches to 6 inches.

16. A tote for carrying 2-liter bottles comprising:

a bottle carrying tote convertible from a folded position to an unfolded position;

a first compartment having a first plurality of walls;

a second compartment having a second plurality of walls;

a handle; and a common wall;

wherein said first plurality of walls extending vertically upward from a first base;

wherein said second plurality of walls extending vertically upward from a second base;

wherein said handle having an aperture for enabling a plurality of fingers to extend therethrough;

wherein said handle extending between said first compartment and said second compartment when said bottle carrying tote is in said unfolded position;

wherein said common wall extending between said first compartment and said second compartment;

wherein said first plurality of walls having a first outer wall;

wherein said second plurality of walls having a second outer wall;

wherein said first outer wall and said second outer wall parallel to said handle;

wherein said first base having a first foldable triangular member adapted to cover a portion of said first base;

wherein said second base having a second foldable triangular member adapted to cover a portion of said second base;

wherein said first outer wall having a first inner tab hingedly adhered to said first outer wall and movable towards said first base for overlapping said first foldable triangular member and covering said first base;

wherein said second outer wall having a second inner tab hingedly adhered to said second outer wall and movable towards said second base for overlapping said second foldable triangular member and covering said second base;

wherein said first foldable triangular member folded along a first bisecting line when said bottle carrying tote is in said folded position;

wherein said second foldable triangular member folded along a second bisecting line when said bottle carrying tote is in said folded position;

wherein said first compartment and said second compartment having a height from 4 inches to 6 inches; and further wherein said handle having a height from two times to four times said height of first compartment and said second compartment.

17. A tote for carrying a plurality of bottles comprising:

a bottle carrying tote convertible from a folded position to an unfolded position;

a first compartment having a first plurality of walls;

a second compartment having a second plurality of walls;

a handle; and a common wall;

wherein said first plurality of walls extending vertically upward from a first base;

wherein said second plurality of walls extending vertically upward from a second base;

wherein said handle having an aperture for enabling a plurality of fingers to extend therethrough;

wherein said handle extending between said first compartment and said second compartment when said bottle carrying tote is in said unfolded position;

wherein said common wall extending between said first compartment and said second compartment;

wherein said first plurality of walls having a first outer wall;

wherein said second plurality of walls having a second outer wall;

wherein said first outer wall and said second outer wall parallel to said handle;

wherein said first base having a first foldable triangular member adapted to cover a portion of said first base;

wherein said second base having a second foldable triangular member adapted to cover a portion of said second base;

wherein said first outer wall having a first inner tab hingedly adhered to said first outer wall and movable towards said first base for overlapping said first foldable triangular member and covering said first base;

wherein said second outer wall having a second inner tab hingedly adhered to said second outer wall and movable towards said second base for overlapping said second foldable triangular member and covering said second base;

wherein said first foldable triangular member folded along a first bisecting line when said bottle carrying tote is in said folded position;

wherein said second foldable triangular member folded along a second bisecting line when said bottle carrying tote is in said folded position;

wherein said first inner tab is horizontal when said bottle carrying tote is in said unfolded position;

wherein said second inner tab is horizontal when said bottle carrying tote is in said unfolded position;

wherein said first inner tab is vertical when said bottle carrying tote is in said folded position; and further wherein said second inner tab is vertical when said bottle carrying tote is in said folded position.

18. The tote for carrying a plurality of bottles of claim 17, wherein said first compartment and said second compartment having a height from 4 inches to 6 inches, and further wherein said handle having a height from two times to four times said height of first compartment and said second compartment.

19. The tote for carrying a plurality of bottles of claim 17, wherein said first inner tab hingedly adhered to a bottom edge of said first outer wall.

20. The tote for carrying a plurality of bottles of claim 19, wherein said second inner tab hingedly adhered to a bottom edge of said second outer wall.

* * * * *